US006990932B2

(12) United States Patent
Kunimitsu et al.

(10) Patent No.: US 6,990,932 B2
(45) Date of Patent: Jan. 31, 2006

(54) MOTORCYCLE LUBRICATION OIL COOLING SYSTEM

(75) Inventors: Motohide Kunimitsu, Shizuoka (JP); Kazuhito Nakamura, Shizuoka (JP)

(73) Assignee: Suzuki Motor Corporation, Shizuoka (JP)

( * ) Notice: Subject to any disclaimer, the term of this patent is extended or adjusted under 35 U.S.C. 154(b) by 253 days.

(21) Appl. No.: 10/299,777

(22) Filed: Nov. 20, 2002

(65) Prior Publication Data

US 2003/0098203 A1 May 29, 2003

(30) Foreign Application Priority Data

Nov. 28, 2001 (JP) ..... 2001-362558

(51) Int. Cl.
*F01P 5/10* (2006.01)

(52) U.S. Cl. ..... 123/41.33; 123/41.47; 123/196 AB

(58) Field of Classification Search ..... 184/6.5–6.9, 184/6.28; 123/196 R, 196 AB
See application file for complete search history.

(56) References Cited

U.S. PATENT DOCUMENTS 4,412,515 A * 11/1983 Fritzenwenger ..... 123/198 E
5,477,817 A * 12/1995 Hufendiek et al. ..... 123/41.33
5,704,329 A * 1/1998 Bublitz et al. ..... 123/195 A
6,247,436 B1 * 6/2001 Lancefield et al. ..... 123/90.38
2002/0026928 A1 * 3/2002 Korenjak et al. ..... 123/572
2003/0037754 A1 * 2/2003 Neal ..... 123/195 C

FOREIGN PATENT DOCUMENTS

EP 505346 A1 * 9/1992
JP 5-131962 5/1993
JP 2000-87755 3/2000

OTHER PUBLICATIONS

English Language Abstract of JP 2000-87755.
English Language Abstract of JP 5-131962.

* cited by examiner

*Primary Examiner*—Noah P. Kamen
(74) *Attorney, Agent, or Firm*—Greenblum & Bernstein, P.L.C.

(57) ABSTRACT

A motorcycle lubrication oil cooling system that cools lubrication oil without increasing the number of parts, weight, or cost, and yet is simple in construction. The cooling system is applicable to motorcycles in which an engine is cooled by a coolant pump driven by a crankshaft. The coolant pump is provided on a side face of the engine, and an oil storage chamber capable of storing a specified amount of lubrication oil is provided adjacent to the coolant pump, while a covering member is provided to cover both the oil storage chamber and a coolant pump chamber that houses the coolant pump. This abstract is neither intended to define the invention discloses in this specification nor intended to limit the scope of the invention in any way.

15 Claims, 7 Drawing Sheets

MOTORCYCLE LUBRICATION OIL COOLING SYSTEM

BACKGROUND OF THE INVENTION

1. Field of the Invention

The present invention relates to the field of motorcycle lubrication oil cooling systems.

2. Description of the Related Art

Since engines include many internal sliding parts and rotating parts, they are designed to function fully by decreasing friction between these parts by providing lubrication oil to lubricate these parts by a lubrication system.

Some lubrication systems have means to cool lubrication oil since lubrication oil loses its lubrication capability when its temperature rises.

When the temperature rise of lubrication oil is relatively small, such as in the case of low speed engines, there are means to prevent the lubrication oil temperature from rising by improving heat release characteristics by increasing the contact surface area between the lubrication oil and the outside air by providing an oil pan and oil tank.

On the other hand, for high speed engines, in which the lubrication oil temperature rise is relatively large requiring active cooling, it has been a general practice to provide an oil cooler to prevent the temperature of lubrication oil from rising.

For example, many oil coolers mounted on motorcycles are of a lightweight and simple construction of an air-cooled type. Yet, since the air cooled-type has limitations in terms of installation location (its full function cannot be utilized unless it is positioned to receive airflow caused by driving). In the case when the engine is water-cooled, some engines are equipped with a water-cooled oil cooler as indicated in Japanese Patent Application Laid-Open (Kokai) H5-131962.

If an oil cooler is provided to achieve a cooling performance beyond what is obtainable by providing an oil pan or an oil tank, the number of parts and the number of assembly process steps involved in piping, etc. will increase over and above what is required for the main oil cooler body. Even for the air-cooled type, a weight increase is unavoidable.

In addition, there are other difficulties resulting from the increase in potential oil leak locations, since the main body of the oil cooler and engine are connected by piping.

There is also a large difference in terms of engine cooling performance, cost, and weight between the systems with and without an oil cooler. There has been no technology to achieve a cooling performance, which is more than what is achieved by providing an oil pan or an oil tank, yet less than what can be achieved by an oil cooler.

SUMMARY OF THE INVENTION

With the foregoing in view, it is an object of the present invention to provide a motorcycle lubrication oil cooling system that will not increase the number of parts, weight, and cost, yet is simple in construction and is capable of cooling lubrication oil.

The motorcycle lubrication oil cooling system of the present invention for solving the problems mentioned above is applicable to motorcycles whose engines are cooled by a coolant pump driven by the crankshaft; the coolant pump is provided beside the engine; an oil storage chamber capable of holding a specified amount of lubrication oil is located adjacent to the coolant pump; and a covering member that covers both the oil storage chamber and the coolant pump chamber that holds the coolant pump.

In order to solve the problems mentioned above, the above mentioned oil storage chamber is provided as a lubrication filtering device housing space capable of housing lubrication oil filtering equipment.

In order to further solve the problems mentioned above, a plurality of cooling fins are formed unitarily and in one piece with the above mentioned covering member on its surface facing the above mentioned oil storage chamber; while at the same time, a plurality of cooling fins are formed on the inner wall of the above mentioned oil storage chamber on the inner wall side that contacts the coolant pump chamber.

In order to solve the problems mentioned above further, a piston cooling lubrication oil injector is provided at the downstream end of the oil passage that first extends from the above mentioned oil storage chamber, and this lubrication oil injector is placed in such a manner that it is directed to the rear side of the piston in the cylinder bore formed in the above mentioned engine.

In order also to solve the problems mentioned above, the above mentioned covering member that covers both the above mentioned oil storage chamber and the above mentioned coolant pump chamber is formed by a material having high thermal conductivity.

An aspect of the present invention includes a lubrication oil cooling system for a motorcycle in which the engine is cooled by a coolant pump driven by a crankshaft, wherein the coolant pump is positioned on a side face of the engine; an oil storage chamber that stores a specified amount of oil is provided adjacent to the coolant pump; and a covering member is provided that covers both of the oil storage chamber and a coolant pump chamber in which the coolant pump is housed. The oil storage chamber may form a space that houses a lubrication oil filtering device.

According to a further aspect of the present invention, the covering member may include a plurality of cooling fins formed on a surface of the covering member facing the oil storage chamber. Further, the covering member that covers both the oil storage chamber and the coolant pump chamber may be formed of a material having a high thermal conductivity. Further, the oil storage chamber may include a plurality of cooling fins formed on an inside wall thereof on a side of the oil storage chamber that adjoins the coolant pump chamber. The plurality of cooling fins formed on the surface of the covering member facing the oil storage chamber may be formed unitarily and in one piece with the covering member; and the plurality of cooling fins formed on the inside wall of the storage chamber may be formed unitarily and in one piece with a clutch housing on the inside wall of the oil storage chamber.

A further aspect of the present invention includes a motorcycle lubrication oil cooling system, wherein a piston cooling lubrication oil injector is provided at a downstream end of an oil passage that extends from the oil storage chamber, and the lubrication oil injector is positioned so that the injector is directed to a rear side of a piston in a cylinder bore formed in the engine.

A further aspect of the present invention includes, in combination, a motorcycle body; an engine; and a motorcycle lubrication oil cooling system.

BRIEF DESCRIPTION OF THE DRAWINGS

The present invention is further described in the detailed description which follows, by reference to the noted plurality of drawings by way of non-limiting examples of preferred embodiments of the present invention, in which like reference numerals represent similar parts throughout the several views of the drawings, and wherein.

DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Preferred embodiments of the present invention are illustrated in FIGS. 1–8.

Figure 1:
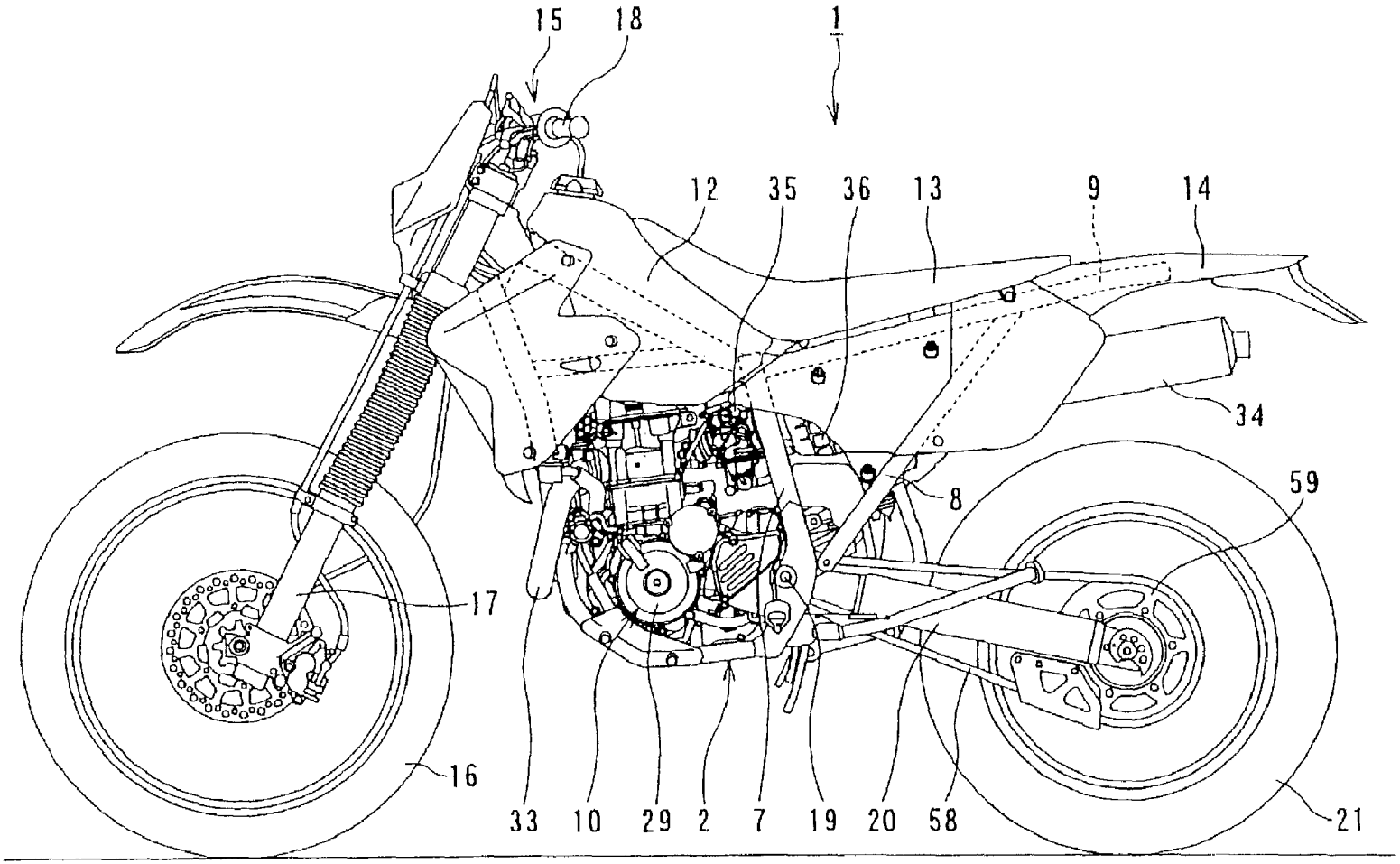
FIG. 1 is a left side view of a motorcycle showing the lubrication oil cooling system for motorcycles, according to one embodiment of the present invention.
Figure 2:
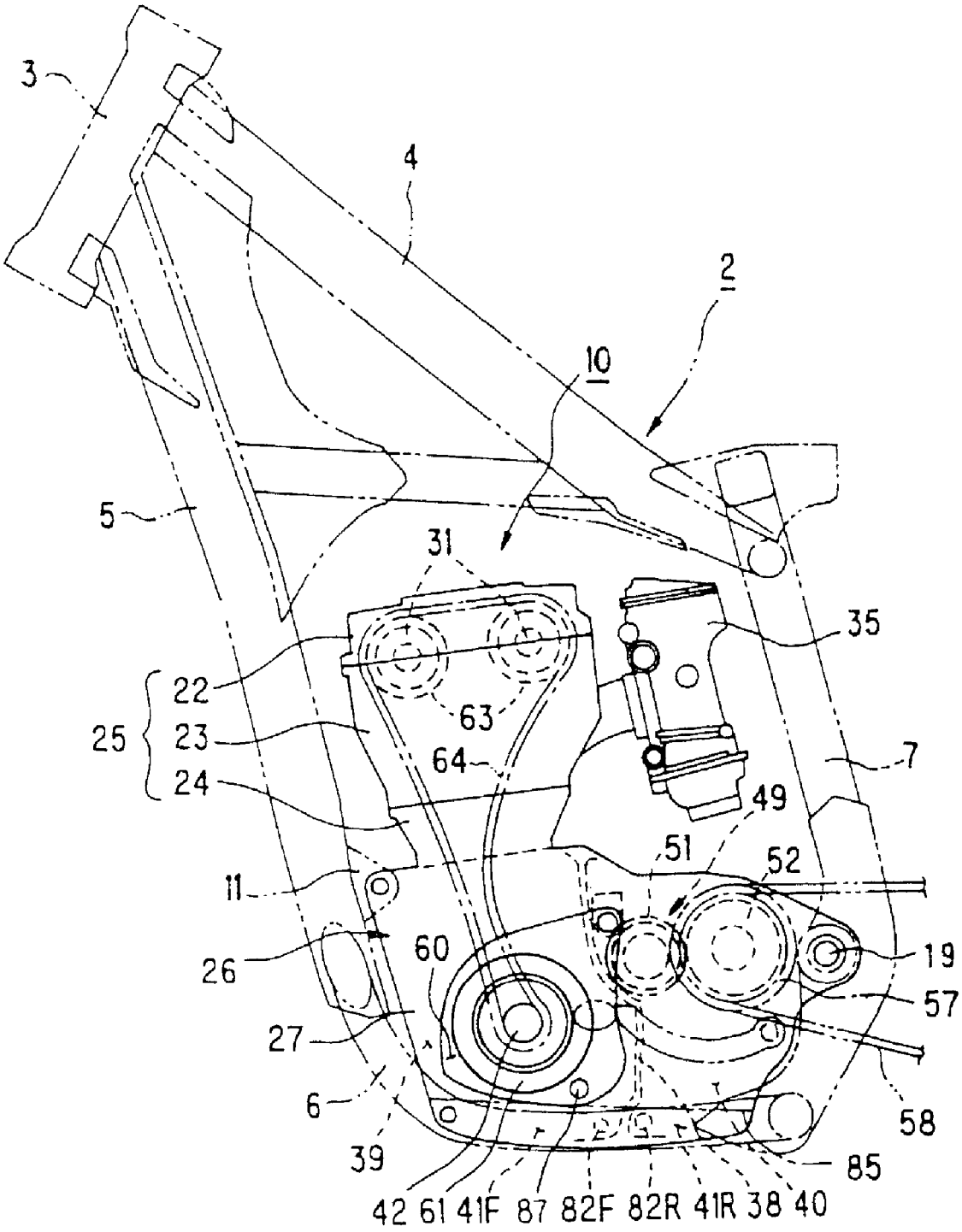
FIG. 2 is an enlarged left side view of the midsection of the body of the motorcycle of FIG. 1.
Figure 3:
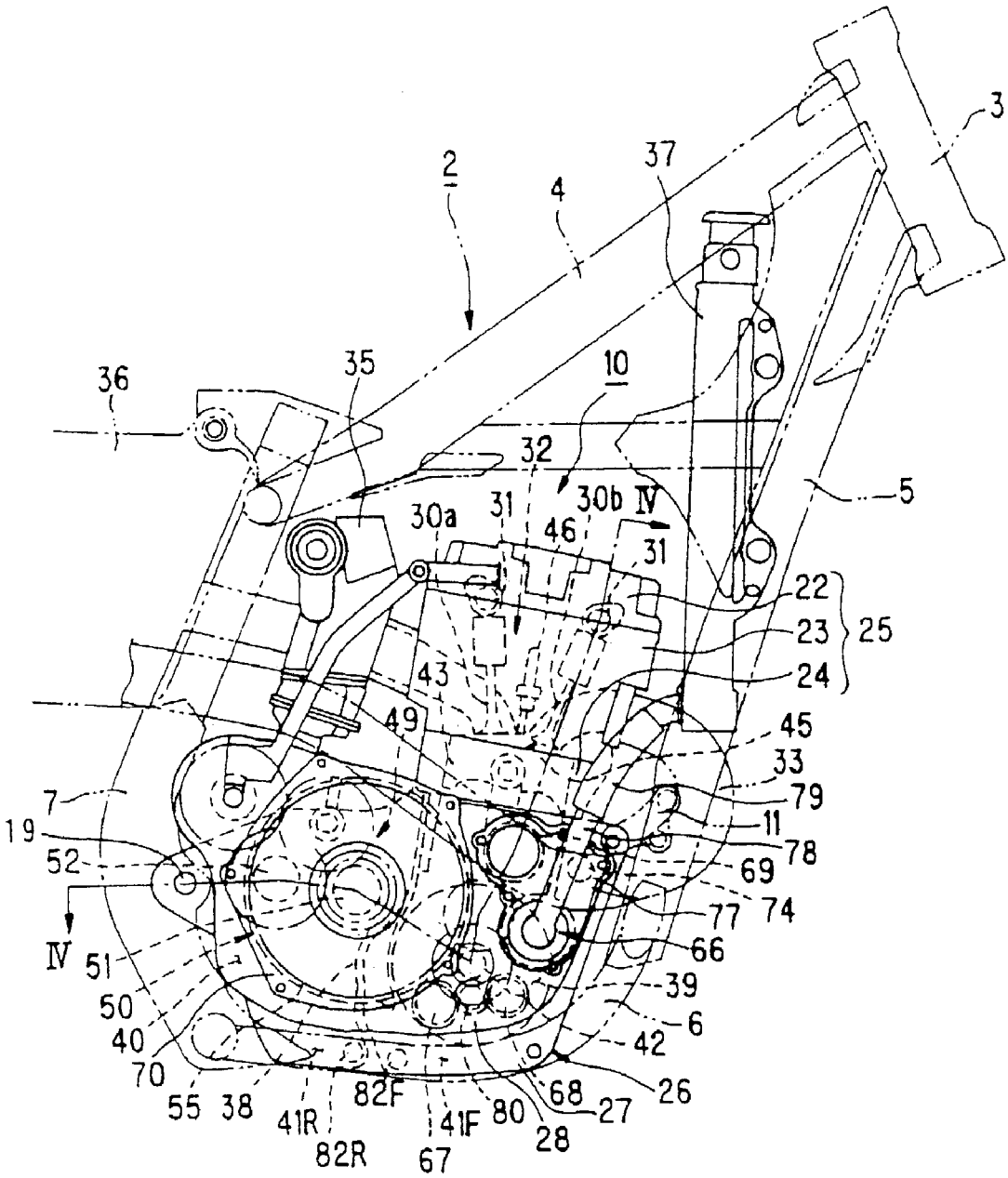
FIG. 3 is an enlarged right side view of the midsection of the body of the motorcycle of FIG. 1.

FIG. 1 is a left side view of one embodiment of a motorcycle of the present invention; and FIG. 2 is an enlarged left side view of the midsection of the body of the motorcycle of FIG. 1. FIG. 3 is an enlarged right side view of the midsection of the body of the motorcycle of FIG. 1. As indicated in FIGS. 1, 2, and 3, this motorcycle 1 has, for example, a semi-double cradle frame type of body frame 2. This body frame 2 includes a head pipe 3, a tank rail 4, vertical tubes 5, lower tubes 6, main tubes 7, rear pipes 8, and seat rails 9.

The head pipe 3 is installed at the forward head section of the body frame 2, and the tank rail 4 extends diagonally downward toward the rear of the frame 2 from the upper rear section of the head pipe 3. In addition, the vertical tubes 5 extend substantially downwardly from the lower rear section of the head pipe 3, so that lower tubes 6 can be connected to the lower end of the vertical tubes 5. Lower tubes 6 are formed in a lateral pair, and extend downwardly initially, and midway bend toward the rear of the frame 2 before extending in a substantially horizontal direction. In addition, the upper end section of a lateral pair of main tubes 7 is laterally connected to the rear end of the tank rail 4. These main tubes 7 extend substantially downwardly before they are connected to the rear end of lower tubes 6.

Tips of a lateral pair of seat rails 9 are connected to the rear end of the tank rail 4, and a pair of rear pipes 8 extends downwardly and forwardly in the direction of the lower portion of main tubes 7.

An engine 10 is mounted at the middle lower section of the body frame 2. As indicated in FIGS. 2 and 3, the engine 10 is anchored to the body frame 2 at three locations, the upper front side, the lower front side, and the rear side. Specifically, the upper front side of the engine 10 is anchored to the vertical tube 5 through a stay 11, while the lower front side of the engine 10 is anchored in a sandwiched manner between the angled sections of the lateral pair of lower tubes 6.

The rear end of the engine 10 is held in a sandwiched manner by a lateral pair of main tubes 7, and each of the attachment sections, as viewed from the side, forms an approximate equilateral triangle. The engine 10 is installed in such a manner that its bottom surface is higher than the bottom surface of lower tubes 6. If viewed from the side, the bottom of the engine 10 and the horizontal section of lower tubes 6 overlap. In addition, a fuel tank 12 is provided above the tank rail 4, and a driver seat 13 and a rear fender 14 are anchored to the seat rail 9.

A steering mechanism 15 is provided on the head pipe 3. A front fork 17, which supports a front wheel 16 in such a manner that it can rotate freely, and a handle bar 18 are provided to the steering mechanism 15, and mounted so as to swivel freely in lateral directions. On the other hand, a swing arm 20 is attached to a pivot shaft 19 (in the same location where the rear part of the engine 10 is sandwiched), which is installed below main tubes 7, in such a manner that a swing arm 20 is able to swivel freely around the pivot shaft 19, the rear end section of which rotatably supports a rear wheel 21, which is the drive wheel.

Figure 4:
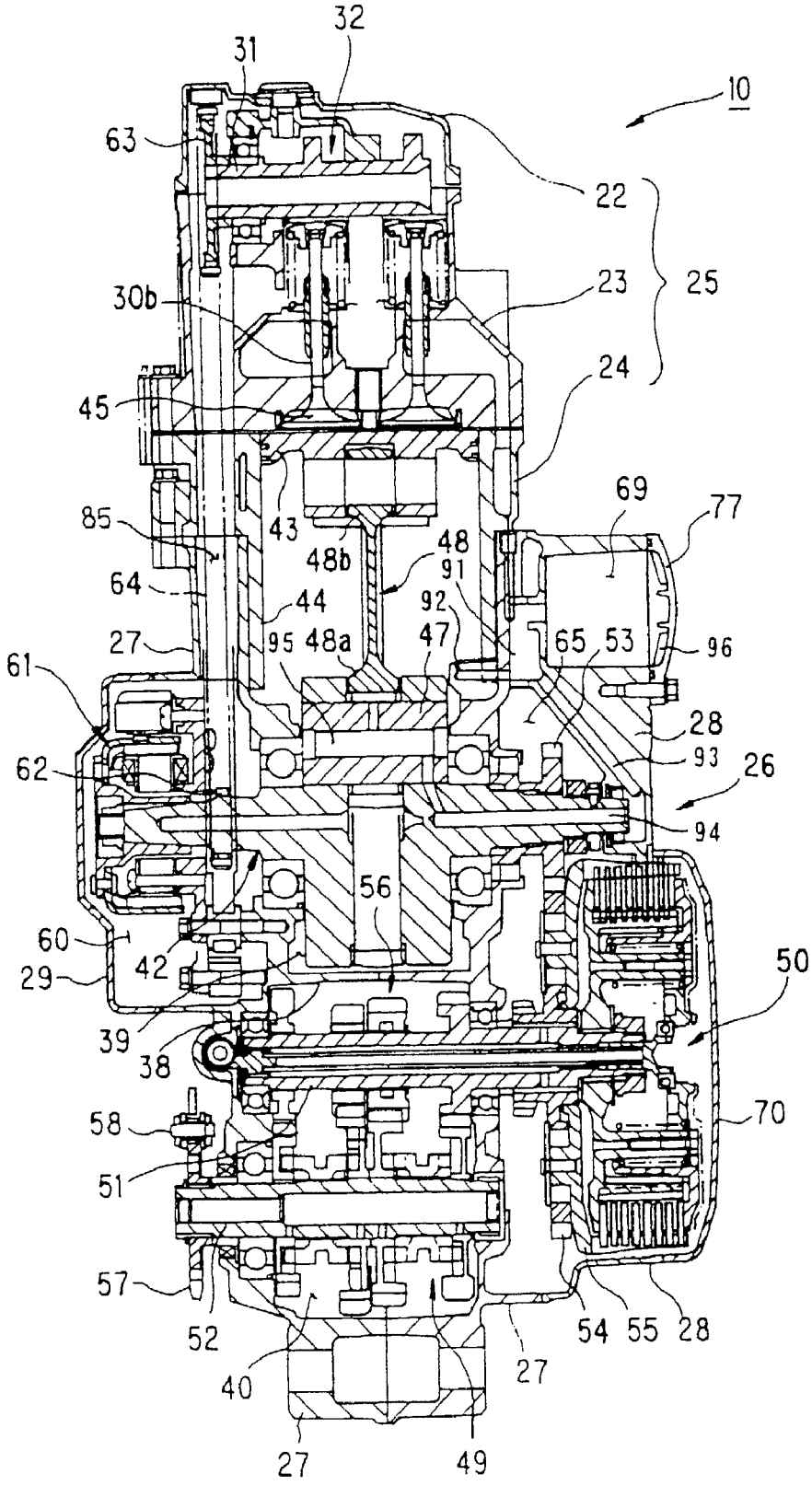
FIG. 4 is a cross-sectional view along line IV—IV in FIG. 3.

FIG. 4 is a cross-sectional view along line IV—IV of FIG. 3.

As can be seen from FIGS. 1 through 4, the engine 10 is, for example, a 4-cycle single cylinder engine, in which a cylinder assembly 25 including sequentially, from the top, a head cover 22, a cylinder head 23, and a cylinder block 24 is placed on an engine case 26 in a slightly forward inclined condition.

The engine case 26 includes mainly a crankcase 27, which is split into left and right halves in the lateral direction of the vehicle; a clutch housing 28, which is provided on the right side surface of the crankcase 27; and a generator cover 29, which is provided on the left side surface of the crankcase 27. The clutch housing 28 and the generator cover 29 are located above the horizontal section of the lower tube 6, and project outwardly in the lateral direction of the vehicle.

Moreover, this engine 10 is a 4-cycle engine equipped, above the cylinder head 23, with a gear mechanism 32 of a double overhead cam shaft (DOHC) type in which a couple of cam shafts 31 are provided, an intake valve 30*a* and an exhaust valve 30*b*, respectively, for opening and closing these valves 30*a* and 30*b*.

An exhaust pipe 33 and a muffler 34 constituting the engine exhaust system are connected to the front section of the cylinder assembly 25. In addition, a carburettor 35 constituting the engine intake system is connected to the rear section of the cylinder assembly 25. Further, an air cleaner 36 located below the driving seat 13 is connected to the upstream side of the carburetor 35. Moreover, a lateral pair of radiators 37 constituting the engine cooling system is provided to the upper front section of the engine 10 and to the lower rear section of the head pipe 3.

As indicated in FIGS. 2 through 4, the interior of the crankcase 27 is divided by a partition wall 38 to form a crank chamber 39 in the front and a transmission chamber 40 in the rear, respectively. In addition, an oil pan 41 is formed below the crankcase 27 to temporarily store lubrication oil that lubricates all engine parts. The oil pan 41 is also divided into the front and rear 41F, 41R portions by the partition wall 38 as in the case of the crankcase 27.

A crankshaft 42 is installed within the crank chamber 39 in the transverse direction of the vehicle, in other words, perpendicular to the travelling direction of the vehicle. A cylinder bore 44 is formed within the cylinder block 24 to house a piston 43. A combustion chamber 45 that matches this cylinder bore 44 is formed within the cylinder head 23, and an ignition plug 46 is inserted from outside toward this combustion chamber 45.

The bottom end 48*a* of a connecting rod 48 is connected to a crankpin 47 located in an approximate center of the crankshaft 42, while the top end 48*b* of the connecting rod 48 is connected to the piston 43. This piston 43 makes reciprocating motions within the cylinder bore 44 in the axial direction thereof, and this reciprocating stroke is transmitted to the crankshaft 42 via connecting rod 48 to produce rotating motions of the crankshaft 42.

On the other hand, a transmission system 49, which is a speed reduction system, is installed in the transmission chamber 40. Provided in this transmission system 49 are a counter shaft 51, which is installed parallel to the crankshaft 42 and inputs the driving power from the crankshaft 42 through a clutch system 50, and a drive shaft 52, which outputs the driving power to the rear wheel 21.

A primary drive gear 53 is provided at one end, or at the right end as shown in FIG. 4 in this embodiment, of the crankshaft 42 so as to rotate together as an integral body, whereas a primary driven gear 54 that meshes with a primary drive gear 53 is provided on the counter shaft 51 in such a manner that they can freely rotate with respect to the counter shaft 51; and the primary driven gear 54 is anchored to a clutch body 55 in the clutch system 50 so as to rotate together as an integral body and to transmit rotational driving power of the crankshaft 42 to the clutch system 50.

A plurality of transmission gears 56 having different numbers of teeth is provided on the counter shaft 51 and to the drive shaft 52. The primary speed reduction is achieved by changing the combination of these transmission gears 56.

One end of the drive shaft 52 protrudes to the outside of the transmission chamber 40, and a drive sprocket 57 is provided at the protruding end of the drive shaft 52. This drive sprocket 57 is connected to a driven sprocket 59, which is provided at the rear wheel 21, through a drive chain 58. The engine driving power is transmitted to the rear wheel 21 after secondary speed reduction through this chain drive.

On the other hand, a generator chamber 60, which is separated from the crankcase 27, is formed on the left side surface of the crankcase 27. In addition, the left end of the crankshaft 42 projects into the generator chamber 60, and a generator 61 is provided at the projecting end. While this generator chamber 60 is covered by the generator cover 29 mentioned earlier, a cam drive gear 62 is provided inside the generator 61 of the crankshaft 42.

In addition, a cam sprocket 63 is provided at one end of each of camshafts 31. This cam sprocket 63 is operationally linked to the cam drive gear 62 through a cam chain 64 to operate the valve train system 32 by transmitting rotation of the crankshaft 42 to the camshaft 31 through a cam chain 64.

Figure 5:
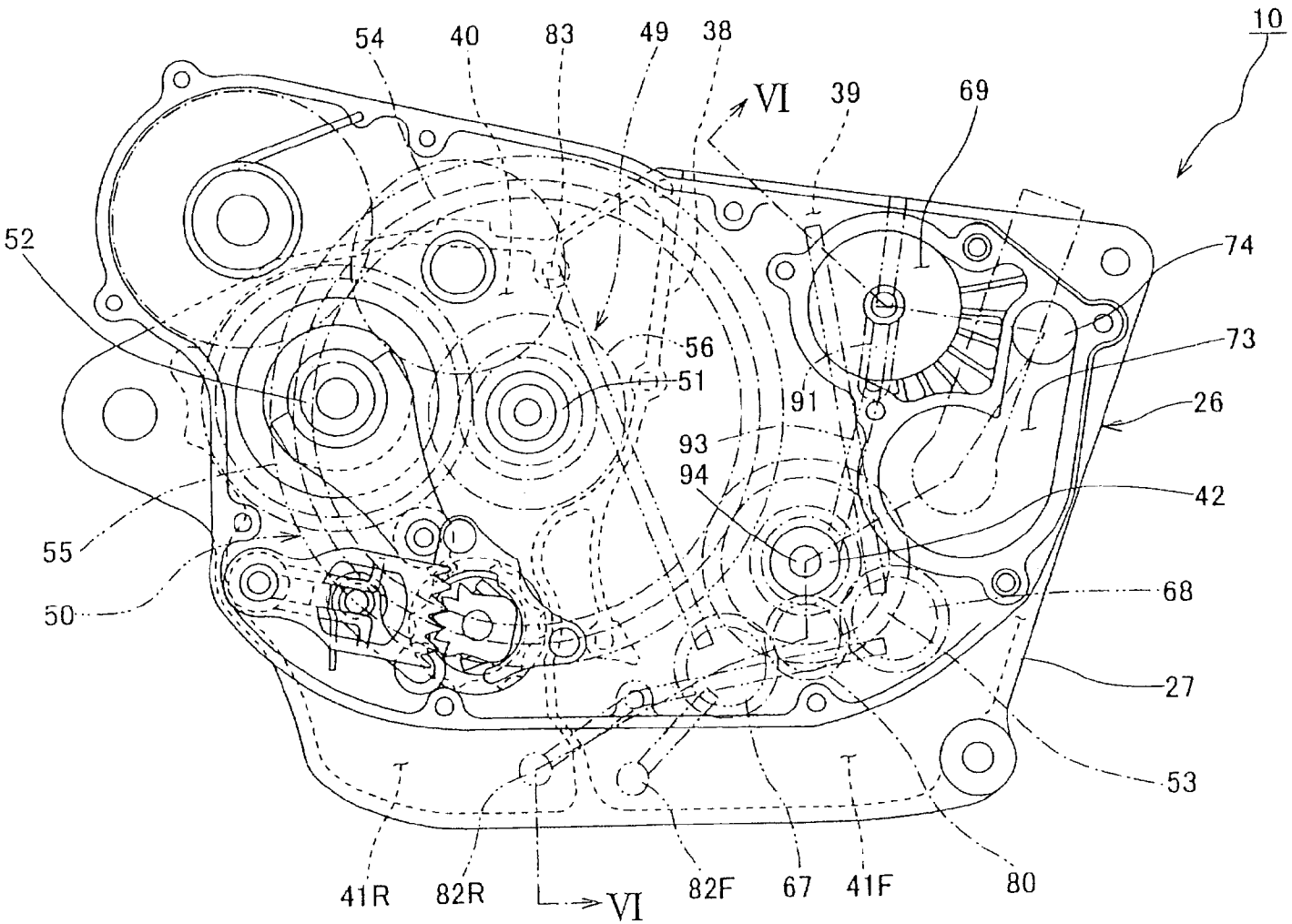
FIG. 5 is a right side view of the crankcase of the motorcycle of the embodiment of FIG. 1.
Figure 6:
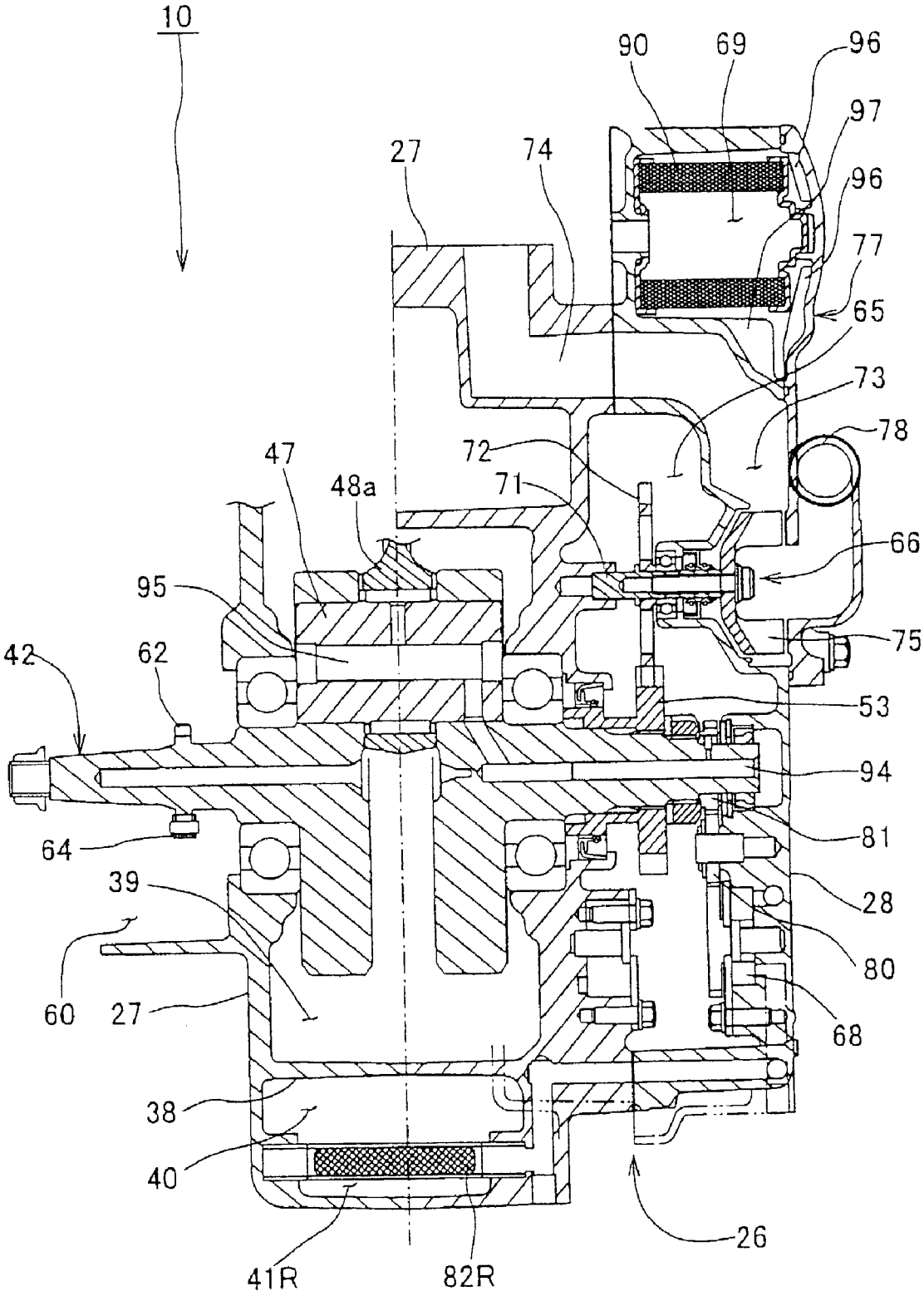
FIG. 6 is a cross-sectional view along line VI—VI in FIG. 5.

FIG. 5 is the right side view of the crankcase, while FIG. 6 is a cross-sectional drawing of the crankshaft along line VI—VI in FIG. 5. As can be seen from FIGS. 3 to 6, the clutch housing 28 mentioned above is located on the right side surface of the crankcase 27, while the clutch body 55 described above is positioned within the rear portion of the frame, and an accessory chamber 65 is formed within the front portion of the frame so that coolant pump 66 and a pair of oil pumps 67 and 68 are housed in this accessory chamber 65. Separately from the accessory chamber 65, an oil storage chamber 69, which is capable of storing a specified amount of lubrication oil, is formed in the clutch housing 28 located next to the coolant pump 66.

In this embodiment, the oil storage chamber 69 is formed as a space for installing a lubrication oil filter, such as for example, an oil filter 90 housed therein. The section in the clutch housing 28, in which the clutch body 55 is housed, is open to the side, and is closed by a detachable clutch cover 70.

As shown in FIG. 6, a coolant pump shaft 71, which is positioned parallel to the crankshaft 42, is rotatably supported between the right side surface of the crankcase 27 and the inner surface of the clutch housing 28. A coolant pump gear 72, which meshes with the above mentioned primary drive gear 53, is provided on the coolant pump shaft 71 so as to rotate together as an integral body. A coolant pump chamber 73, in which the above mentioned coolant pump 66 is housed, is formed within the clutch housing 28 at the side of coolant gear pump 72. This coolant pump chamber 73 is connected to a coolant passage 74, which is formed in the crankcase 27.

The right side end of the coolant pump shaft 71 projects toward the outside of the coolant pump chamber 73, and an impeller 75 is provided at the projecting end on the coolant pump body 66. The above mentioned oil storage chamber 69 is located adjacent to the coolant pump chamber 73. This oil storage chamber 69 and the coolant pump chamber 73 are covered by a covering member 77 that is formed unitarily and in one piece from a material having a high thermal conductivity, such as aluminium or the like. A coolant union 78 is provided to this covering member 77. And a coolant hose 79 extends from this coolant union 78 to the above mentioned radiator 37. (see FIG. 3)

As indicated in FIGS. 3, 5 and 6, a pair of oil pumps 67 and 68 is provided within the crankcase 27, one of which is a scavenging pump for suction, while the other of which is a lubrication oil feed pump 68. Both of these oil pumps 67 and 68 are operationally connected to an oil pump drive gear 81, which is provided at the right end of the crankshaft 42 through an oil pump drive gear 80.

As indicated in FIG. 5, the scavenging pump 67 withdraws lubrication oil from an oil strainer 82F located within the oil pan 41F portion on the side of the crank chamber 39, and supplies the lubrication oil by dripping for example, to all parts in the transmission system 49 including the counter shaft 51 and the drive shaft 52 from a transmission lubrication oil passage 83, which is provided at an upper portion within the transmission chamber 40. The lubrication oil that lubricates all parts in the transmission system 49 accumulates within an oil pan 41R located on the side of the transmission chamber 40.

On the other hand, the feed pump 68 withdraws lubrication oil from an oil strainer 82R located within an oil pan 41R on the side of the transmission chamber 40, and guides the lubrication oil to all parts of the crankshaft 42, the piston 43 and the valve train system 32 through the oil storage chamber 69.

Specifically, for example, as indicated in FIG. 4, a first oil passage 91 extends from the oil storage chamber 69 first toward the lower interior of the cylinder block 24. An oil nozzle 92, which is a piston cooling lubrication oil injector, is positioned at the downstream end of the first oil passage in such a manner that it is directed to the rear side of the piston 43 in the cylinder bore 44. Lubrication oil injected from this nozzle 92 lubricates the sliding contact surface between the cylinder bore and the piston 43 while cooling them at the same time.

A second oil passage 93 branches off midway in the first oil passage 92 and extends toward the right end of the crankshaft 42, as viewed in FIG. 4. Lubrication oil that is guided to the right side of the crankshaft 42, for example, passes through a third oil passage 94, which is formed within the crankshaft 42, and through a fourth oil passage 95 before it is guided to the sliding contact surface between the piston pin 47 and the large end 48*a* of the connecting rod 48 to lubricate this sliding surface.

Part of the lubrication oil that has lubricated all the parts mentioned above falls into the above mentioned generator chamber 60 through the side of the cylinder assembly 25, or through a cam chain tunnel 85 which is a space for arranging the cam chain 64 that is on the left side in this embodiment, as viewed in FIG. 4. In addition, in order to prevent the generator 61 from becoming immersed in lubrication oil, most of the lubrication oil falls naturally into the crank chamber 39 through a connecting hole 87 that is bored into the left side surface of the crankcase 27 before it accumulates in the oil pan 41F next to the crank chamber 39.

When lubrication oil that has accumulated in the oil pan 41F next to the crank chamber 39 becomes greater than a specified amount, the rotational resistance of the crankshaft 42 increases, necessitating the withdrawal of lubrication oil that exceeds the amount of lubrication oil that can be pushed out by the above mentioned feed pump 68 to the side of the transmission chamber 40. For this reason, the scavenging pump 67 has a greater capacity than the feed pump.

Figure 7:
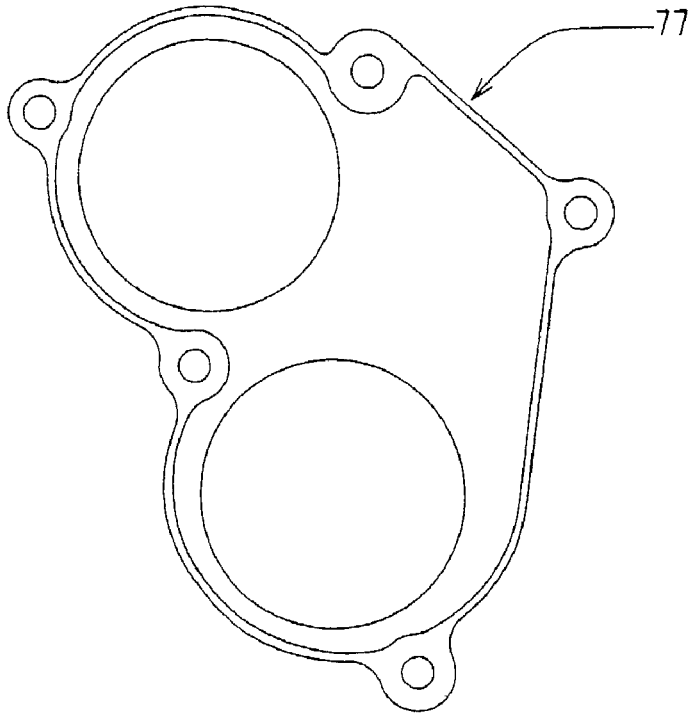
FIG. 7 is a drawing showing the outer surface of a covering member.
Figure 8:
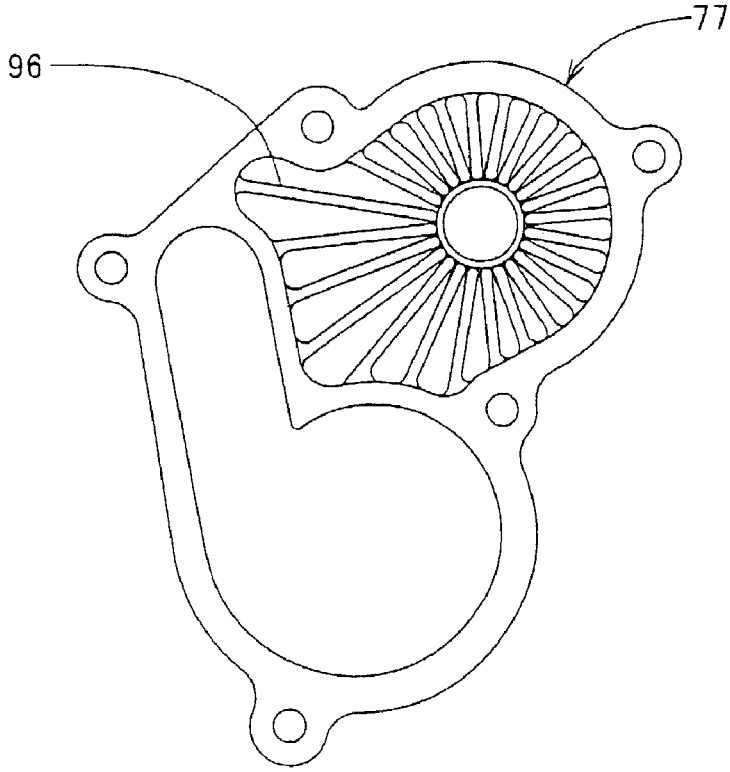
FIG. 8 is a drawing showing the inner surface of the covering member of FIG. 7.

FIG. 7 shows the outer surface of above mentioned covering member 77, while FIG. 8 shows the inner surface or rear side of the covering member 77. As shown in FIG. 7, the covering member 77 is formed as an integral body made of a material having high thermal conductivity in such a manner that it covers both the oil storage chamber 69 and the coolant pump chamber 73, which are located adjacent each other. As indicated in FIGS. 6 and 8, a plurality of cooling fins 96 are formed unitarily and in one piece with the covering member 77 on the inner surface facing the oil storage chamber 69. A plurality of cooling fins 97 are also formed unitarily and in one piece with the clutch housing 28 on the inside wall of the oil storage chamber 69 in the side touching the coolant pump chamber 73.

Described hereinafter are the operations of an embodiment of this invention.

The coolant pump 66, which is rotationally driven by the crankshaft 42 through the primary drive gear 53 and the coolant pump gear 72, and the oil storage chamber capable of holding a specified amount of lubrication oil are provided adjacent to the coolant pump 66 in the clutch housing 28, which is located at the right side surface of the crankcase 27. With this arrangement, it is possible to cover both the oil storage chamber 69 and the coolant pump chamber 73, in which the coolant pump 66 is housed, under one covering member 77, which results in the reduction in the number of parts, the number of assembly line process steps, and weight.

The oil storage chamber 69 is established as a space for housing lubrication oil filtering equipment, inside of which the oil filter 90, which is a lubrication oil filtering device, is housed. With this design, lubrication oil in the oil storage chamber 69 can be cooled by coolant in the coolant pump chamber 73 through the covering member 77. Since the oil filter 90 does not require driving power, it is fully possible to install an oil storage chamber 69 adjacent to the coolant pump 66, which is located next to the crankshaft 42.

A plurality of cooling fins 96 are formed unitarily and in one piece with the covering member 77 on the inner surface of the covering member 77 facing the oil storage chamber 69, while a plurality of cooling fins are also formed unitarily and in one piece with the clutch housing 28 on the inside wall of the oil storage chamber on the side touching the coolant pump chamber 73. With this design, the contact area between lubrication oil and the covering member 77 increases resulting in an improvement in the lubrication oil cooling efficiency.

In addition, the oil nozzle 92, which is a lubrication oil injecting device for piston cooling, is provided in the downstream end of the first oil passage 91, which first extends from the oil storage chamber 69, in such a manner that the nozzle points to the rear side of the piston 43 in the cylinder bore. The system is so configured so that lubrication oil injected from this oil nozzle 92 can lubricate the sliding surface between the cylinder bore 44 and the piston 43. With this design, it is possible to inject lubrication oil, which is cooled in the oil storage chamber 69, into the cylinder bore 44 before its temperature is elevated by other parts of the engine 10, resulting in an improvement in the cooling performance of the piston 43.

In addition, the covering member 77, which covers the oil storage chamber 69 and the coolant pump chamber that houses the coolant pump 66, is formed unitarily and in one piece of any suitable material having a high thermal conductivity such as, for example, aluminium. With this design, the heat conduction from the oil storage chamber 69 to the coolant pump chamber 73 increases, resulting in the decrease in the lubrication oil temperature and a further increase in the cooling efficiency and further improvement in the cooling performance of all parts of the engine 10.

Finally, according to the configuration of the present embodiment described above, it is possible to obtain a cooling performance, e.g., active cooling of the piston 43, without providing an oil cooler and without using a large size oil pan 41, better than what is achievable by providing a large oil pan 41 or a large oil tank.

In addition, since there are no complicated piping systems, there should be no large scale increase in the number of parts, number of processing steps, weight, and cost. Since the number of locations having potential oil leakage will not increase, the number of sealing members can be decreased, leading to improved engine reliability.

Since the exterior undulation of the engine 10 decreases compared with the case in which an oil cooler is mounted, the amount of mud adhesion to the exterior of the engine 10 when driving over muddy ground decreases, leading to improved serviceability.

Although the embodiment of this invention described above showed an example in which the oil storage chamber 69 is provided next to the coolant pump 66 so that one covering member 77 covers both the oil storage chamber 69 and the coolant pump chamber, which houses the coolant pump, this design may be replaced by the following, although the details of which are not shown here by drawings. For example, oil pumps 67 and 69 may be provided next to the coolant pump 66 in lieu of the oil storage chamber 69, so that one covering member (not shown in the drawing) can cover both the oil pump chamber (not shown in the drawing), which houses oil pumps 67 and 68, and the coolant pump chamber, which houses the coolant pump 66, As explained above, according to the present invention related to the motorcycle lubrication oil cooling system, it is possible to improve cooling efficiency by lowering the lubrication oil temperature.

In addition, the number of parts, the number of assembly process steps, and the weight can be decreased.

Furthermore, the cooling performance of engine parts can be improved.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

The present disclosure relates to the subject matter contained in priority Japanese Application No. 2001-362558, filed on Nov. 28, 2001, which is herein expressly incorporated by reference in its entirety.

What is claimed is:

1. A lubrication oil cooling system for a motorcycle in which the engine is cooled by a coolant pump driven by a crankshaft, wherein:

said coolant pump is positioned on a side face of the engine in an engine case, said coolant pump including a gear meshing with a gear of said crankshaft;

an oil storage chamber that stores a specified amount of oil is provided adjacent to said coolant pump in said engine case; and a covering member is provided that covers both of said oil storage chamber and a coolant pump chamber in which said coolant pump is housed, said covering member covering substantially only said oil storage chamber and said coolant pump chamber;

wherein said covering member is formed unitarily and in one piece.

2. The motorcycle lubrication oil cooling system according to claim 1, wherein said oil storage chamber forms a space that houses a lubrication oil filtering device.

3. The motorcycle lubrication oil cooling system according to claim 1, wherein said covering member includes a plurality of cooling fins formed on a surface of said covering member facing said oil storage chamber.

4. The motorcycle lubrication oil cooling system according to claim 3, wherein said oil storage chamber includes a plurality of cooling fins formed on an inside wall thereof on a side of said oil storage chamber that adjoins said coolant pump chamber.

5. The motorcycle lubrication oil cooling system according to claim 3, wherein said plurality of cooling fins formed on the surface of said covering member facing said oil storage chamber are formed unitarily and in one piece with said covering member.

6. The motorcycle lubrication oil cooling system according to claim 1, wherein said oil storage chamber includes a plurality of cooling fins formed on an inside wall thereof on a side of said oil storage chamber that adjoins said coolant pump chamber.

7. The motorcycle lubrication oil cooling system according to claim 6, wherein said plurality of cooling fins formed on the inside wall of said storage chamber are formed unitarily and in one piece with a clutch housing on said inside wall of the oil storage chamber.

8. The motorcycle lubrication oil cooling system according to claim 1, wherein a piston cooling lubrication oil injector is provided at a downstream end of a first oil passage that extends from said oil storage chamber, and said lubrication oil injector is positioned so that said injector is directed to a rear side of a piston in a cylinder bore formed in said engine.

9. The motorcycle lubrication oil cooling system according to claim 1, wherein said covering member that covers both said oil storage chamber and said coolant pump chamber is formed of a material including aluminum.

10. In combination, a motorcycle body;

an engine; and a motorcycle lubrication oil cooling system according to claim 1.

11. A lubrication oil cooling system for a motorcycle in which the engine is cooled by a coolant pump driven by a crankshaft, wherein:

said coolant pump is positioned on a side face of the engine;

an oil storage chamber that stores a specified amount of oil is provided adjacent to said coolant pump; and a covering member is provided that covers both of said oil storage chamber and a coolant pump chamber in which said coolant pump is housed;

wherein said covering member includes a plurality of cooling fins formed on a surface of said covering member facing said oil storage chamber.

12. The motorcycle lubrication oil cooling system according to claim 11, wherein said oil storage chamber includes a plurality of cooling fins formed on an inside wall thereof on a side of said oil storage chamber that adjoins said coolant pump chamber.

13. The motorcycle lubrication oil cooling system according to claim 11, wherein said plurality of cooling fins formed on the surface of said covering member facing said oil storage chamber are formed unitarily and in one piece with said covering member.

14. A lubrication oil cooling system for a motorcycle in which the engine is cooled by a coolant pump driven by a crankshaft, wherein:

said coolant pump is positioned on a side face of the engine;

an oil storage chamber that stores a specified amount of oil is provided adjacent to said coolant pump; and a covering member is provided that covers both of said oil storage chamber and a coolant pump chamber in which said coolant pump is housed;

wherein said oil storage chamber includes a plurality of cooling fins formed on an inside wall thereof on a side of said oil storage chamber that adjoins said coolant pump chamber.

15. The motorcycle lubrication oil cooling system according to claim 14, wherein said plurality of cooling fins formed on the inside wall of said storage chamber are formed unitarily and in one piece with a clutch housing on said inside wall of the oil storage chamber.

* * * * *